US010723540B2

(12) United States Patent
Roberts

(10) Patent No.: US 10,723,540 B2
(45) Date of Patent: Jul. 28, 2020

(54) BEVERAGE CAN HOLDER

(71) Applicant: Ryan A. Roberts, Marietta, GA (US)

(72) Inventor: Ryan A. Roberts, Marietta, GA (US)

( * ) Notice: Subject to any disclaimer, the term of this patent is extended or adjusted under 35 U.S.C. 154(b) by 0 days.

(21) Appl. No.: 16/231,625

(22) Filed: Dec. 24, 2018

(65) Prior Publication Data

US 2019/0127141 A1 May 2, 2019

Related U.S. Application Data

(62) Division of application No. 29/598,624, filed on Mar. 28, 2017, now Pat. No. Des. 836,405, and a division of application No. 29/598,625, filed on Mar. 28, 2017, now Pat. No. Des. 836,406.

(51) Int. Cl.

| | |
|---|---|
| ***B65D 81/38*** | (2006.01) |
| ***A47G 23/02*** | (2006.01) |
| *A47G 19/22* | (2006.01) |

(52) U.S. Cl.

CPC ..... *B65D 81/3881* (2013.01); *A47G 23/02* (2013.01); *A47G 23/0266* (2013.01); *A47G 19/2288* (2013.01); *A47G 2023/0275* (2013.01)

(58) Field of Classification Search

CPC ..... F25D 3/08

USPC ..... 220/903, 737; 215/395; 62/530, 457, 62/457.4, 457.2

See application file for complete search history.

(56) References Cited

U.S. PATENT DOCUMENTS 4,183,226 A * 1/1980 Moore ..... B65D 81/3883 220/903
4,638,645 A * 1/1987 Simila ..... F25D 3/08 62/371
5,361,604 A * 11/1994 Pier ..... B65D 81/3883 62/371
6,419,108 B1 * 7/2002 Toida ..... A47G 19/2288 220/592.17
6,705,110 B1 * 3/2004 Worsham ..... F25D 31/007 62/371
8,251,247 B1 * 8/2012 Breckner ..... A47G 23/0266 220/592.16
8,534,345 B1 * 9/2013 French ..... A47J 41/00 165/10
9,580,229 B2 * 2/2017 Thomas ..... B65D 81/3876
9,915,472 B2 * 3/2018 Sabo ..... B65D 47/06
2002/0088810 A1 * 7/2002 Murakami ..... B65D 81/3881 220/739
2013/0020223 A1 * 1/2013 White ..... A47G 23/0233 206/459.5
2014/0263382 A1 * 9/2014 Arnold ..... B60N 3/108 220/739

* cited by examiner

*Primary Examiner* — J. Gregory Pickett
*Assistant Examiner* — Tia Cox
(74) *Attorney, Agent, or Firm* — Larry A. Roberts

(57) ABSTRACT

A thermally insulated holder for beverage cans includes a cylindrical sleeve and a retaining ring that couples to the upper end of the sleeve. A beverage can fits into the sleeve with the upper portion of the can extending above the sleeve. The retaining ring has a circular opening in its upper wall that engages the shoulder of the can to clamp the can in place. The retaining ring has a side wall that extends outward of the sleeve and down over the upper end of the sleeve. The lower edge of the retaining ring side wall defines a ledge. A user can grasp the sleeve with one or more fingers in contact with the ledge to provide a more comfortable and secure grip.

9 Claims, 4 Drawing Sheets

BEVERAGE CAN HOLDER

CROSS-REFERENCE TO RELATED APPLICATIONS

The present application is a divisional of U.S. patent application Ser. No. 29/598,624, filed Mar. 28, 2017, and of U.S. patent application Ser. No. 29/598,625, filed Mar. 28, 2017.

BACKGROUND OF THE INVENTION

Technical Field

The invention relates generally to a thermally insulated can holder for keeping canned drinks cold. More specifically, a beverage can or bottle fits into a thermally insulating sleeve and is secured within the sleeve by a removable retaining ring.

Background Art

A "can holder" is a sleeve into which a beverage can is inserted to isolate the can from the user's hands. Among other functions, the holder helps insulate the beverage can from the ambient air and keeps the beverage in the can cool longer. The holder can keep the user's hands from getting cold from contact with a cold beverage can, and it can prevent heat from the user's hand from warming up the beverage prematurely. In addition, depending upon the material from which the can holder is made, it can absorb moisture or otherwise prevent condensation from forming on the can and dripping or leaving a ring on a surface.

A relatively recent development in the field of can holders is the thermally insulated, double wall can holder. A cylindrical sleeve is fabricated with two spaced-apart, coaxial, stainless-steel walls defining an annular cavity between them. A partial vacuum exists in the cavity between the walls. The cylindrical sleeve is closed on the bottom and open at the top. This can holder construction reduces heat transfer from the ambient to the contents of the can; conductive heat transfer is reduced by the space between the walls, and convective heat transfer is reduced by the partial vacuum between the walls.

A standard 12 U.S. fl. oz. can fits closely within the sleeve of such a thermally insulated, double wall can holder. A retaining ring screws onto the upper end of the sleeve and has a circular hole in its upper surface with a diameter larger than the lid of the can but smaller than the body of the can. When a can is placed in the sleeve and the retaining ring is screwed onto the sleeve, the top of the can protrudes above the ring. The edge of the circular hole in the upper surface of the retaining ring engages the shoulder of the can to clamp the can in place within the sleeve.

The dual cylindrical walls of the sleeve and the space between the walls, added to the diameter of the can, results in a sleeve of some girth and adds weight to the canned beverage. For those with small hands or weak grip strength, the thermally insulated, double-wall sleeve, especially with a full drink, can be a challenge to hold. The same is true when the user's hands or the exterior of the smooth, stainless-steel sleeve are wet or otherwise slick.

Thus there is a need for an improved can holder for canned beverages.

There is a further need for a can holder that is easier to hold, particularly for users who have small hands or diminished grip strength.

BRIEF SUMMARY OF THE INVENTION

The present invention relates to an improved beverage can holder. An insulated sleeve has a cylindrical body portion. The body portion defines a cylindrical chamber configured to closely receive the major portion of a beverage can. The sleeve includes an upstanding, externally threaded, annular collar at its upper end. An internally threaded retaining ring is mountable to the externally threaded collar. The retaining ring has a circular opening in its upper surface. The circular opening has a diameter greater than the diameter of the top of a beverage can The retaining ring is configured such that, when a beverage can is placed within the sleeve and the retaining ring screwed onto the upper end of the sleeve, the edge of the circular opening in the upper surface of the retaining ring engages the can to retain the can within the sleeve.

The retaining ring has a downwardly extending annular wall. The inner diameter of the annular wall is larger than the diameter of the cylindrical main body portion of the sleeve. The retaining ring is configured such that, when the ring is coupled to the sleeve, the wall extends down around the upper portion of the cylindrical main body of the sleeve. The lower portion of the skirt forms an annular ledge. As the user grips the can holder, he or she can place one or more fingers in contact with the lower edge of the ledge to make the can holder easier to grip.

Thus it is an object of the present invention to provide an improved can holder for keeping canned beverages cold.

It is a further object of the present invention to provide a double-wall, vacuum insulated can holder that is easier to hold than prior double-wall, vacuum insulated can holders.

It is another object of the present invention to provide a double-wall, vacuum insulated can holder that users with small hands or diminished grip strength can hold more comfortably and securely than prior double-wall, vacuum insulated can holders.

Still another object of the present invention is to provide a double-wall, vacuum insulated can holder that can be held more securely and comfortably when the surface of the can holder, the user's hands, or both are wet or slick.

Other objects, features, and advantages of the present invention will become apparent upon reading the following specification in view of the drawings and the appended claims.

DETAILED DESCRIPTION OF THE DISCLOSED EMBODIMENT

Figure 1:
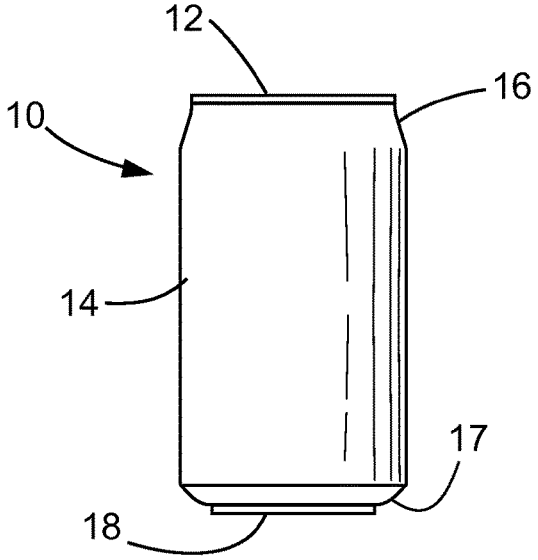
FIG. 1 PRIOR ART
FIG. 1 is an isometric view of a PRIOR ART standard 12 U.S. fl. oz. beverage can.

Reference is now made to the drawings, in which like numerals indicate like elements throughout the several views. The can holder of the disclosed embodiment is intended for use with a standard 12 U.S. fl. oz. (355 ml) can 10, depicted in FIG. 1. The can 10 has a lid 12, a cylindrical side wall 14 having a diameter larger than the diameter of the lid 12, and a tapered shoulder 16 joining the lid to the upper end of the side wall 14. At the lower end of the can 10, a curved profile 17 extends from the lower end of the side wall 14 to join the side wall to the bottom 18 of the can 10.

A standard 12 U.S. fl. oz. can such as that shown in FIG. 1 typically has the following dimensions:

| Dimension | Inches | mm |
|---|---|---|
| Height of the can 10 | 4.83 | 122.7 |
| Diameter of the lid 12 | 2.13 | 54.1 |
| Diameter at widest point of the side wall 14 | 2.60 | 66.17 |

Figure 2:
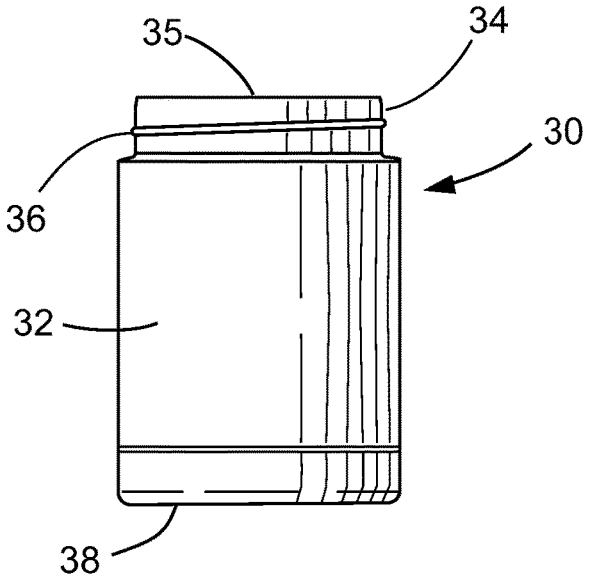
FIG. 2 is a side view of a thermally insulated sleeve of a beverage can holder according to a disclosed embodiment of the present invention.
Figure 3:
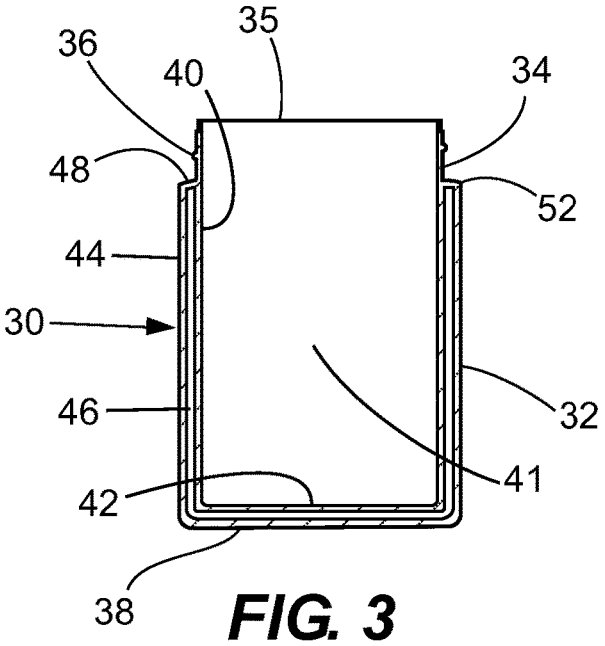
FIG. 3 is a vertical cross-sectional view of the thermally insulated sleeve of FIG. 2.
Figure 4:
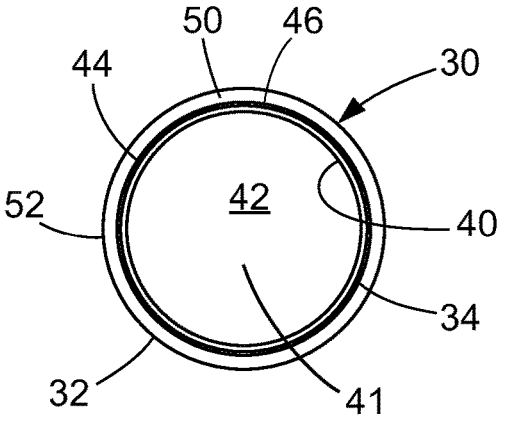
FIG. 4 is a top view of the sleeve of FIG. 2.

FIGS. 2-4 illustrate a thermally insulated can holder sleeve 30 according to an embodiment of the present invention. The sleeve 30 includes a cylindrical main body 32 and a coaxial upstanding collar 34. The upper edge of the collar 34 comprises a rim 35. Helical threads 36 are formed on the outer surface of the collar 34. The lower end of the main body 32 of the sleeve 30 defines the bottom 38 of the sleeve.

Referring now to FIGS. 3 and 4, the sleeve 30 comprises a cylindrical inner wall 40 extending from just above the bottom 38 of the sleeve and upward to the rim 42. The upper portion of the cylindrical inner wall 40 forms the collar 34. The cylindrical inner wall 40 defines the vertical wall of a cylindrical can-receiving chamber 41. A base 42 closes the lower end of the chamber 41.

A cylindrical outer wall 44 is coaxial to and spaced outwardly from the inner wall 40. The outer wall 44 extends from the bottom 38 of the sleeve 30 to the upper end of the main body 32, terminating proximate the lower end of the collar 34. An annular space 46 is formed between the inner and outer walls 40, 44. Some of the air in the annular space 46 between the inner and outer walls 40, 44 is evacuated to create a partial vacuum between the walls.

A shoulder 48 is formed at the upper end of the outer wall 44. The shoulder 48 tapers inward toward the inner wall 40 to close the upper end of the annular space 46 between the inner and outer walls. The shoulder 48 joins the upper end of the outer wall 44 to the lower end of the collar 34 of the sleeve 30.

In the disclosed embodiment, the cylindrical chamber 41 has a diameter slightly larger than the outer diameter of a standard 12 fl. oz. US beverage can 10, such that a can fits within the chamber 41 with minimal clearance between the can's side wall 14 and the inner wall 40 of the sleeve 30. The height of the cylindrical can-receiving chamber 41 is such that, when a can 10 is positioned within the chamber 41, an upper section of the can comprising the lid 12 and a portion of the shoulder 16 of the can extends above the upper rim 35 of the sleeve 30.

In the disclosed embodiment, by way of example only and without limiting the invention, the insulating sleeve 30 has the following dimensions:

| Dimension | Inches | mm |
|---|---|---|
| Height of the insulating sleeve 30 | 4.7 | 119.4 |
| Outer diameter of the main body 32 of the sleeve 30 | 3.12 | 79.25 |
| Diameter of can-receiving chamber 41 | 2.63 | 66.8 |
| Depth of the can-receiving chamber 41 | 4.15 | 105.4 |
| Height of the collar 34 | 0.68 | 17.27 |
| Outer diameter at collar 34 (excluding threads) | 2.8 | 71.12 |
| Thickness of inner sleeve wall 40 | 0.02 | 0.5 |
| Thickness of outer sleeve wall 44 | 0.03 | 0.7 |
| Space 46 between inner and outer walls 40, 44 | 0.31 | 8.0 |

Figure 5:
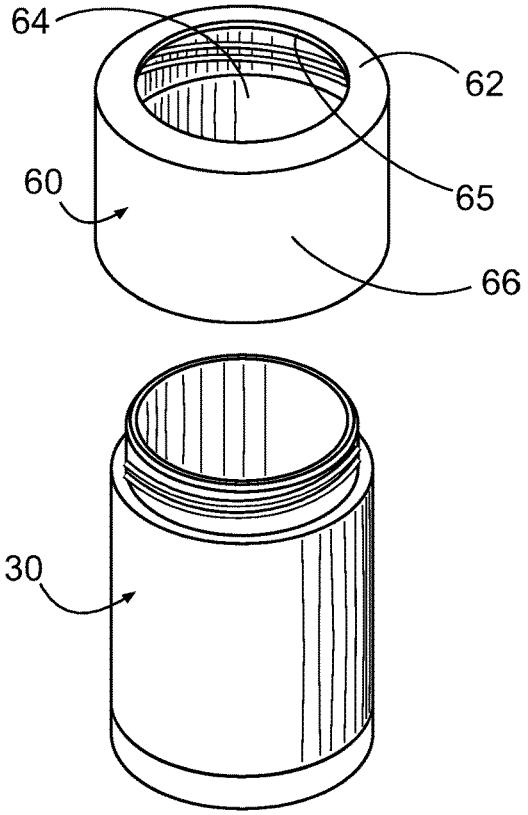
FIG. 5 is an exploded isometric view of a beverage can holder comprising the sleeve of FIG. 2 and a retaining ring.
Figure 6:
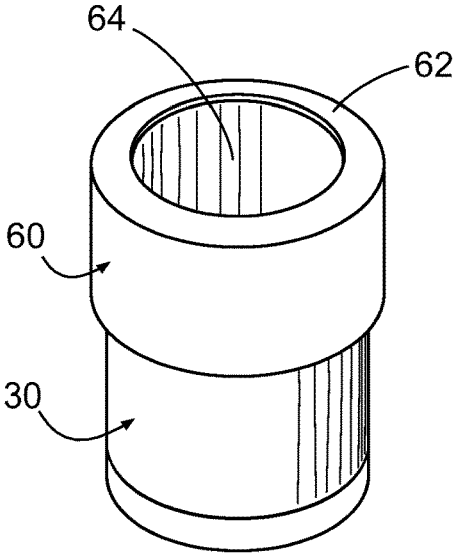
FIG. 6 is an isometric view of the assembled beverage can holder of FIG. 5.
Figure 7:
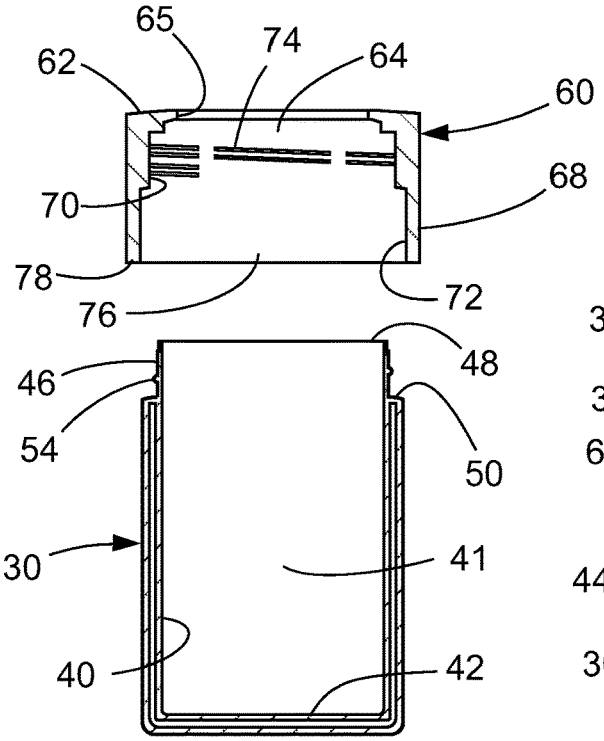
FIG. 7 is an exploded vertical section view of the beverage can holder of FIG. 5.

FIGS. 5-7 illustrate a retaining ring 60 for use with the sleeve 30. The retaining ring 60 has an upper wall 62. The upper wall 62 of the retaining ring 30 defines a circular opening 64 having an edge 65. The circular opening 64 has a diameter that is greater than the diameter of the lid 12 of a can 10 but smaller than the diameter of the can at the widest part of the can body 14.

The retaining ring 60 has a side wall 68 that extends downward from the outer periphery of the upper wall 62. The inward facing portion of the side wall 68 comprises an inner surface that defines stepped, coaxial, upper and lower inner cylindrical cavities 70, 72. The diameter of the upper cylindrical cavity 70 is smaller than the diameter of the lower cylindrical cavity 72. Helical threads 74 are formed on the wall of the upper cylindrical cavity 70. A circular opening 76 is formed at the lower end of the retaining ring 60. The lower edge of the retaining ring side wall 68 defines a ledge 78.

Figure 8:
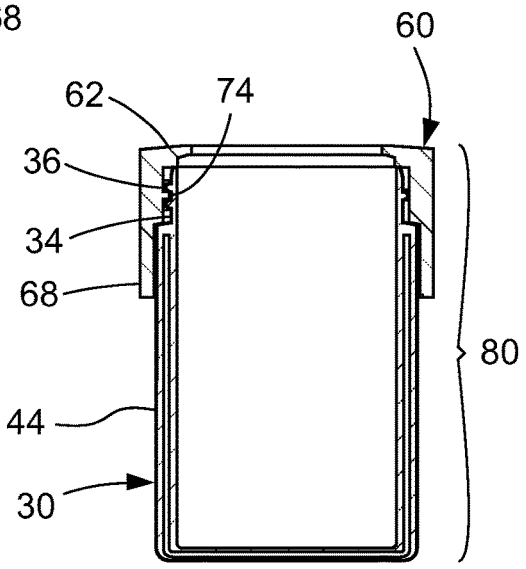
FIG. 8 is a vertical section view of the beverage can holder of FIG. 5.

FIG. 8 shows the retaining ring 60 assembled onto the top of the sleeve 30. Together the sleeve 30 and retaining ring 60 form a can holder 80. The inward facing threads 74 on the retaining ring 60 engage the cooperating threads 36 on the annular collar 34 of the sleeve 30. When the retaining ring 60 is assembled onto the sleeve 30, the collar 34 is received within the upper cylindrical cavity 70 of the retaining ring, and the upper portion of the cylindrical outer wall 44 of the sleeve is received within the lower cylindrical cavity 72 of the retaining ring. The side wall 68 of the retaining ring 30 extends outward of the cylindrical outer wall 44 of the sleeve 30 and down over an upper portion of the outer wall of the sleeve.

Figure 9:
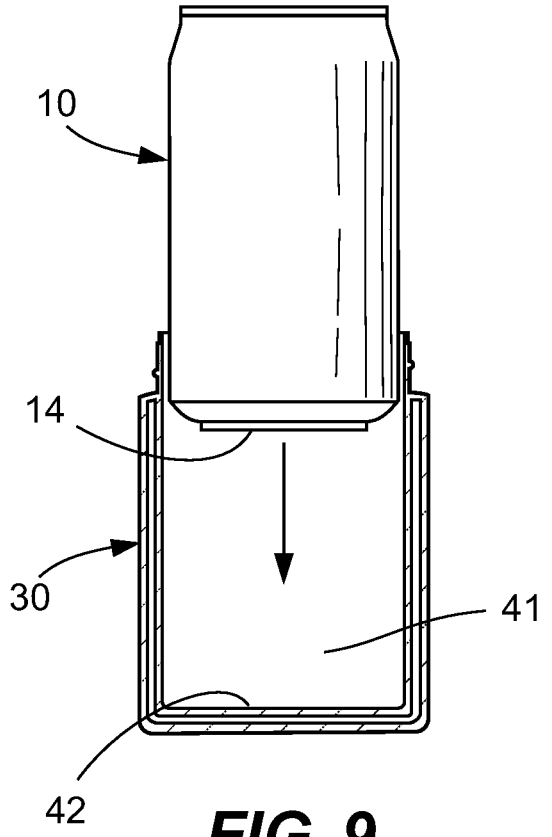
FIG. 9 is a vertical section view of the beverage can holder of FIG. 8 showing a can of FIG. 1 being inserted into the holder.
Figure 10:
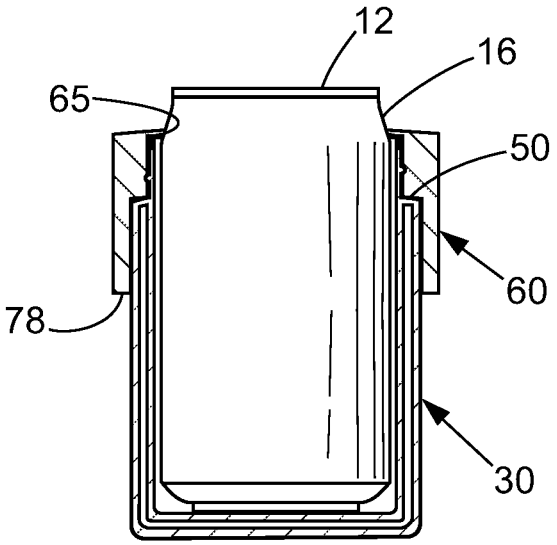
FIG. 10 is a side view of the beverage can and beverage can holder of FIG. 9, showing the can located within the holder of FIG. 5, and with the holder shown in vertical cross section to reveal interior detail.

FIGS. 9 and 10 illustrate a can 10 being inserted into the can-receiving chamber 41 of the sleeve 30. When the can 10 is fully inserted into the sleeve 30, the bottom 18 of the can rests on the base 42 of the chamber 41.

With further reference to FIG. 10, the retaining ring 60 has been screwed onto the collar 34 of the sleeve 30. The edge 65 of the circular opening 64 of the retaining ring clears the lid 12 of the can 10 and engages the tapered shoulder 16 of the can, clamping the can securely within the sleeve 30.

Figure 11:
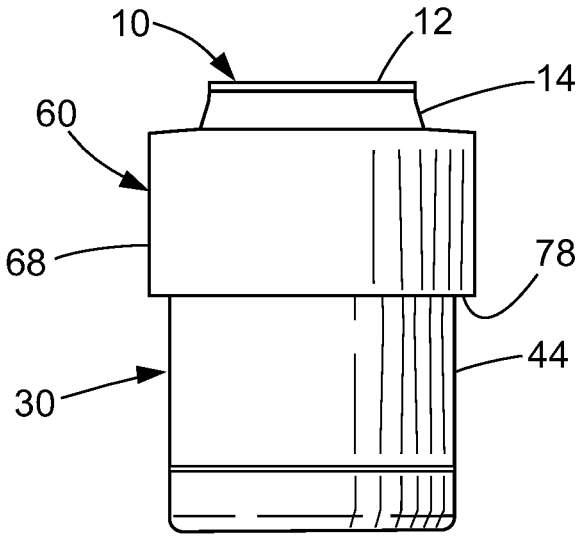
FIG. 11 is a side view of the beverage can and beverage can holder of FIG. 10.
Figure 12:
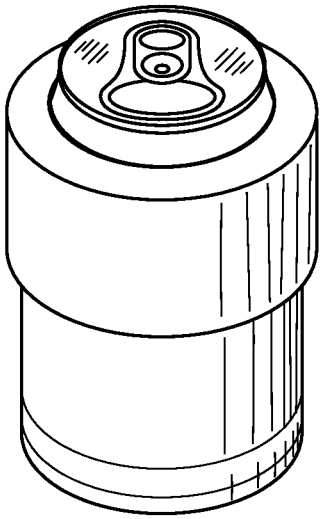
FIG. 12 is an isometric view of the beverage can and beverage can holder of FIG. 10.

Looking now at FIGS. 10-12, when the retaining ring 60 is secured to the upper end of the sleeve 30, a portion of the can 10 including the lid 12 and a portion of the can shoulder 16 is exposed above the upper surface 62 of the retaining ring. The side wall 68 of the retaining ring 60 extends outward of the cylindrical outer wall 44 of the sleeve 30 and down over the upper end of the outer sleeve wall 44. The circumferential ledge 78 formed by the lower end of the sleeve side wall 68 is disposed below the shoulder 50 of the sleeve 30.

A user can grasp the main body 32 of the sleeve 30 and place the upper edge of his index finger, the upper edge of his thumb, or both against the ledge 78 to make it easier to grip the can holder 80. This feature can be particularly beneficial for users who have diminished grip strength or small hands. It is also advantageous when the user's hands or the surface of the can holder 80 are slick, such as when they are wet or oily.

In an alternate embodiment, the opening 64 of the retaining ring 30 has substantially the same diameter as the side wall 14 of the can 10. An interference fit, a frictional engagement, or both between the vertical edge 65 of the opening 64 and the side wall 14 of the can 10 holds the can in place within the can-receiving chamber 41 of the sleeve 30. In this embodiment, a drink can be inserted into and withdrawn from the can holder 80 without having to remove the retaining ring 60 from the insulating sleeve 30.

The construction of the can holder 80 inhibits heat transfer from the ambient to the can-receiving chamber 41 in multiple ways. First, the spaced-apart relation between the inner and outer walls 40, 44 reduces conductive heat transfer between the ambient and the cylindrical can-receiving chamber 41. Also, the vacuum in the annular space 46 between the inner and outer walls 40, 44 helps minimize convective heat transfer between the inner and outer walls. Further, the space between the can 10 and the inner wall 40 of the sleeve prevents conductive heat transfer between the side wall 14 of the can and the sleeve 30.

Before a can 10 is placed into the can-receiving chamber 41 of the sleeve 30, the chamber is occupied by ambient air, which almost always is warmer than the chilled beverage can. The more air surrounding the can, the more heat from the air will heat up the can and its contents. To minimize the amount of ambient air remaining in the chamber 41 after a can 10 is inserted, it is desirable to have the inner wall 40 of the sleeve 30 be very close to the can 10 without touching. The coaxial opening 64 in the retaining ring 60 keeps the can 10 centered within the sleeve 30 and prevents the can from touching the side wall 40 of the sleeve. Optionally, a ridge or depression in the base 42 of the can-receiving chamber 41 can further aid in centering the can 10 within the sleeve 30.

In this first disclosed embodiment 80, and by way of example only, the distance between the wall 40 of the can-receiving chamber 41 and the side wall 32 of the can 10 is approximately 0.015 inches (0.32 mm).

Figure 13:
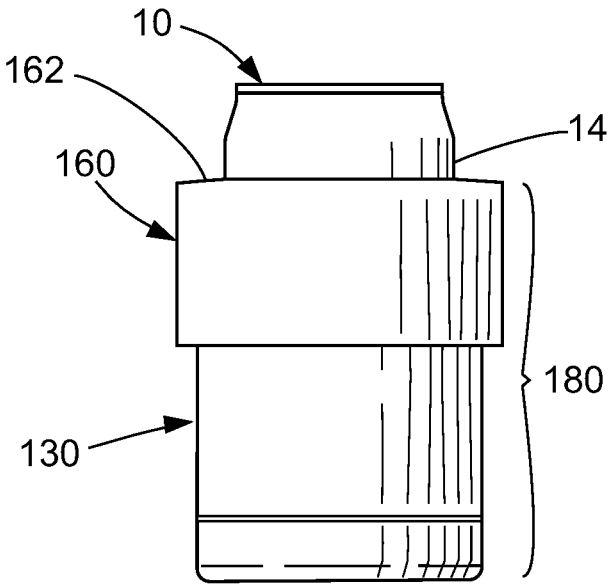
FIG. 13 is a side view of a second embodiment of a beverage can and beverage can holder, in which the retaining ring engages the side wall of the can.

FIG. 13 illustrates a second embodiment of a can holder 180 including a sleeve 130 and retaining ring 160. In this embodiment, when a can 10 is positioned within the chamber of the sleeve 130, a greater portion of the can, including a portion of the side wall 14, extends above the rim of the sleeve. This exposure of a greater portion of a can above the rim of the sleeve can be accomplished either by making the sleeve shorter, by raising the base of the can-receiving chamber, or by placing in a sleeve 30, e.g., a 16 fl. oz. can, which is taller but essentially the same diameter as the 12 fl. oz. can 10.

With an upper portion of the cylindrical side wall 14 of the can 10 extending above the rim of the sleeve 130, the edge of the opening in the upper wall 162 of the retaining ring 160 engages the side wall of the can, instead of the shoulder 16 of the can as in the previous embodiment.

Figure 14:
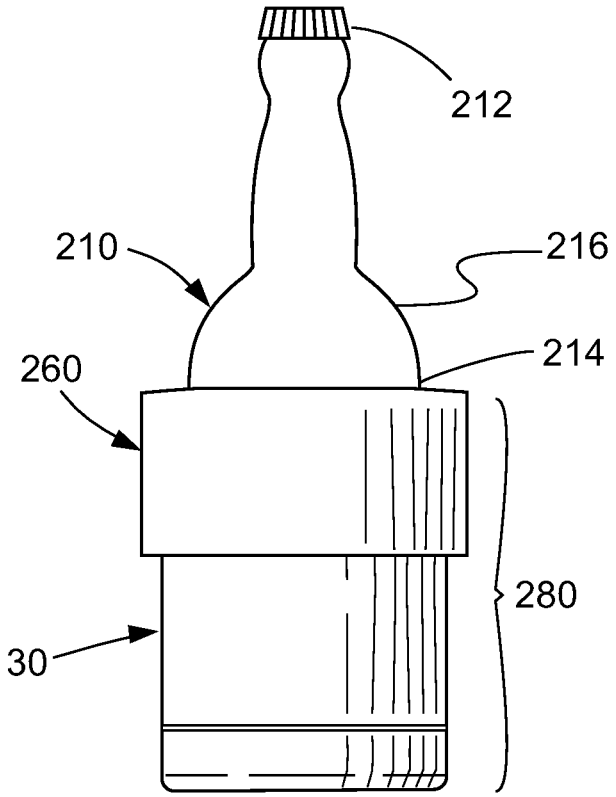
FIG. 14 is a side view of a third embodiment of a beverage can holder with a bottle positioned in the sleeve.

FIG. 14 depicts a third embodiment of a can holder 280 including a sleeve 30 and a retaining ring 260. In FIG. 14 the can holder 280 holds a beverage bottle 210, instead of a can 10. Because of the shape and height of the bottle 210, a portion of the bottle including the cap 212, tapered shoulder 216 of the bottle neck, and upper portion of the cylindrical side wall 214 is exposed above the rim of the sleeve 30. The edge 265 of the opening 264 in the upper wall 262 of the retaining ring 260 engages the side wall 214 of the bottle 210.

In the case of the last two embodiments 180, 280, the circular opening in the top wall of the retaining ring is sized to engage the side wall of a can or bottle to retain it in the insulated sleeve. Even if the fit is a little loose, if the gap between the side wall of the can or bottle and the edge of the opening in the retaining ring is sufficiently small, it will be difficult for air to get past the gap to enter the receiving chamber of the sleeve. A partial vacuum is thus created within the chamber of the sleeve that inhibits the can or bottle from easily sliding out of the sleeve when the user inverts the can holder to take a drink.

As used herein, terms such as top, bottom, left, right, front, rear, horizontal, vertical, and the like are used with reference to the drawings for convenience of description. Unless stated otherwise, use of such words is not intended to limit the invention to any particular orientation.

Finally, it will be understood that the foregoing embodiments have been disclosed by way of example, and that other modifications may occur to those skilled in the art without departing from the scope and spirit of the appended claims.

What is claimed is:

1. A holder for a beverage container having a cylindrical side wall, an upper container end having a diameter smaller than the diameter of said cylindrical container side wall, and a shoulder tapering upward and inward from said upper end of said cylindrical container side wall toward said upper container end, said holder comprising:

a cylindrical sleeve having a base, a tubular main body extending upward from said base, and a collar at the upper end of said main body and coaxial therewith;

said tubular main body of said sleeve defining a cylindrical chamber dimensioned to receive a lower portion of said beverage container therewithin; and a retaining ring for mounting to said collar of said sleeve, said retaining ring comprising:

an upper retaining ring wall having a periphery and comprising edges defining an opening therein, said opening having a diameter greater than said upper container end;

a side wall extending downward from said periphery of said upper retaining ring wall, said side wall having an inner surface, and a lower end of said side wall defining a ledge;

said inner surface of said side wall defining upper and lower coaxial cylindrical cavities;

said lower cylindrical cavity of said retaining ring having a diameter greater than the diameter of said main body of said cylindrical sleeve;

said sleeve comprising threads formed on an exterior surface of said collar;

said retaining ring comprising threads formed on said inner surface of said side wall within said upper cylindrical cavity, said threads on said retaining ring being configured to engage said threads on said collar of said sleeve to mount said retaining ring to said sleeve;

said retaining ring being configured such that when a beverage container is positioned within said sleeve and said retaining ring is mounted to said collar of said sleeve, said upper container end is received through said opening in said upper retaining ring wall, and said edges defining said opening engage said beverage container to retain said beverage container within said sleeve; and said retaining ring further being configured such that when said retaining ring is mounted to said collar of said sleeve, said collar of said sleeve is received within said upper cylindrical cavity of said retaining ring, an upper portion of said main body of said cylindrical sleeve is received within said lower cylindrical cavity of said retaining ring, and said side wall of said retaining ring extends downward below said upper end of said main sleeve body.

2. The holder of claim 1, wherein said opening in said upper retaining ring wall further has a diameter less than the diameter of said cylindrical container side wall, such that when a beverage container is positioned within said sleeve and said retaining ring is mounted to said collar of said sleeve, said edges of said opening in said upper retaining ring wall engage the shoulder of said beverage container to retain said beverage container within said sleeve.

3. The holder of claim 1, wherein said tubular main body of said sleeve comprises coaxial inner and outer walls defining an annular space therebetween, and wherein a partial vacuum s formed in said annular space between said inner and outer walls.

4. The holder of claim 1, wherein said upper cylindrical cavity has a diameter less than the diameter of said lower cylindrical cavity.

5. A holder for a beverage container having a cylindrical side wall, an upper container end having a diameter smaller than the diameter of said cylindrical container side wall, and a shoulder tapering upward and inward from said upper end of said cylindrical container side wall toward said upper container end, said holder comprising:

a cylindrical sleeve having a base, a tubular main body extending upward from said base, and a collar at the upper end of said main body and coaxial therewith;

said tubular main body of said sleeve defining a cylindrical chamber dimensioned to receive a lower portion of said beverage container therewithin; and said tubular main body of said sleeve comprising coaxial inner and outer walls defining an annular space therebetween, a partial vacuum existing in said annular space between said inner and outer walls;

said sleeve further comprising threads formed on an exterior surface of said collar; and a retaining ring for mounting to said collar of said sleeve, said retaining ring comprising:

an upper retaining ring wall having a periphery and comprising edges defining an opening therein, said opening having a diameter greater than the diameter of said upper container end and less than the diameter of said cylindrical container side wall, a side wall extending downward from said periphery of said upper retaining ring wall, said side wall having an inner surface, and a lower end of said side wall defining a ledge;

said inner surface of said side wall defining upper and lower coaxial cylindrical cavities, said upper cylindrical cavity having a diameter less than the diameter of said lower cylindrical cavity;

said side wall within said upper cylindrical cavity having threads formed thereon and being configured to engage said threads on said collar of said sleeve to mount said retaining ring to said sleeve, and said lower cylindrical cavity of said retaining ring having a diameter greater than the diameter of said main body of said cylindrical sleeve;

said retaining ring being configured such that when a beverage container is positioned within said sleeve and said retaining ring is mounted to said collar of said sleeve, said upper container end is received through said opening in said upper retaining ring wall, and said edges defining said opening engage said beverage container to retain said beverage container within said sleeve; and said retaining ring further being configured such that when said retaining ring is mounted to said collar of said sleeve, said collar of said sleeve is received within said upper cylindrical cavity of said retaining ring, an upper portion of said main body of said cylindrical sleeve is received within said lower cylindrical cavity of said retaining ring, and said side wall of said retaining ring extends downward below said upper end of said main sleeve body;

whereby when a beverage container is positioned within said sleeve and said retaining ring is mounted to said collar of said sleeve, said edges of said opening in said upper retaining ring wall engage the shoulder of said beverage container to retain said beverage container within said sleeve.

6. A beverage container and holder, comprising:

a beverage container having a cylindrical side wall, an upper container end having a diameter smaller than the diameter of said cylindrical container side wall, and a shoulder tapering upward and inward from said upper end of said cylindrical container side wall toward said upper container end;

a holder comprising a cylindrical sleeve having a base, a tubular main body extending upward from said base, and a collar at the upper end of said main body and coaxial therewith;

said tubular main body of said sleeve defining a cylindrical chamber dimensioned to receive a lower portion of said beverage container therewithin; and said holder further comprising a retaining ring for mounting to said collar of said sleeve, said retaining ring comprising:

an upper retaining ring wall having a periphery and comprising edges defining an opening therein, said opening having a diameter greater than said upper container end;

a side wall extending downward from said periphery of said upper retaining ring wall, said side wall having an inner surface, and a lower end of said side wall defining a ledge;

said inner surface of said side wall defining upper and lower coaxial cylindrical cavities;

said lower cylindrical cavity of said retaining ring having a diameter greater than the diameter of said main body of said cylindrical sleeve;

said sleeve comprising threads formed on an exterior surface of said collar;

said retaining ring comprising threads formed on said inner surface of said side wall within said upper cylindrical cavity, said threads on said retaining ring being configured to engage said threads on said collar of said sleeve to mount said retaining ring to said sleeve;

said retaining ring being configured such that when said beverage container is positioned within said sleeve and said retaining ring is mounted to said collar of said sleeve, said upper container end is received through said opening in said upper retaining ring wall, and said edges defining said opening engage said beverage container to retain said beverage container within said sleeve; and said retaining ring further being configured such that when said retaining ring is mounted to said collar of said sleeve, said collar of said sleeve is received within said upper cylindrical cavity of said retaining ring, an upper portion of said main body of said cylindrical sleeve is received within said lower cylindrical cavity of said retaining ring, and said side wall of said retaining ring extends downward below said upper end of said main sleeve body.

7. The beverage container and holder of claim 6, wherein said opening in said upper retaining ring wall further has a diameter less than the diameter of said cylindrical container side wall, such that when a beverage container is positioned within said sleeve and said retaining ring is mounted to said collar of said sleeve, said edges of said opening in said upper retaining ring wall engage the shoulder of said beverage container to retain said beverage container within said sleeve.

8. The beverage container and holder of claim 6, wherein said tubular main body of said sleeve comprises coaxial inner and outer walls defining an annular space therebetween, and wherein a partial vacuum is formed in said annular space between said inner and outer walls.

9. The beverage container and holder of claim 6, wherein said upper cylindrical cavity has a diameter less than the diameter of said lower cylindrical cavity.

* * * * *